United States Patent [19]

Kraft

[11] Patent Number: 4,529,065

[45] Date of Patent: Jul. 16, 1985

[54] ELEVATOR SYSTEM

[75] Inventor: David P. Kraft, Parsippany Township, Morris County, N.J.

[73] Assignee: Westinghouse Electric Corp., Pittsburgh, Pa.

[21] Appl. No.: 544,194

[22] Filed: Oct. 21, 1983

[51] Int. Cl.[3] ..... B66B 13/16

[52] U.S. Cl. ..... 187/57; 187/61

[58] Field of Search ..... 187/61, 57, 56, 51, 187/30, 31, 52 LC, 52 R; 49/449; 292/144, 201

[56] References Cited

U.S. PATENT DOCUMENTS

| | | | |
|---|---|---|---|
| 3,878,919 | 4/1975 | Dewhurst | 187/52 |
| 4,313,525 | 2/1982 | McDonald | 187/57 |
| 4,357,998 | 11/1982 | Gibson et al. | 187/61 X |
| 4,364,454 | 12/1982 | Glaser et al. | 187/57 |
| 4,436,184 | 3/1984 | Dorman et al. | 187/57 X |

*Primary Examiner*—Joseph J. Rolla
*Assistant Examiner*—Nils E. Pedersen
*Attorney, Agent, or Firm*—Donald R. Lackey

[57] ABSTRACT

An elevator system including an elevator car having an electromechanical door restraint mechanism which includes a locked position which permits slight opening of the door by passengers for ventilation purposes, while preventing the forcible opening of the elevator car door beyond that point when the elevator car stops outside a predetermined allowable displacement zone adjacent to a floor level. Power supply failure deenergizes a first solenoid of the mechanism which causes the door restraint mechanism to assume its locked position. A capacitor, charged by the power supply before failure thereof, energizes a second solenoid to unlock the door when the elevator car is within an allowable displacement zone, and the closed door is moved slightly by a passenger towards its open position. Continued movement of the car door, beyond the predetermined point, returns the mechanism to the locked position, which now prevents complete closure of the car door.

6 Claims, 5 Drawing Figures

SEC
DLS
SLT

ELEVATOR SYSTEM

BACKGROUND OF THE INVENTION

1. Field of the Invention

The invention relates in general to elevator systems, and more specifically to a new and improved electrically operated arrangement for preventing the doors of an elevator car from being forcibly opened when the elevator car stops outside a predetermined allowable displacement zone from a floor level, while permitting opening of the doors when the car is within the allowable zone, notwithstanding power failure.

2. Description of the Prior Art

In certain instances, an elevator car may stop for an unscheduled length of time, displaced from a landing or floor. This may occur due to the failure of the electrical power supplied to the building, or because of an occurrence which triggers an emergency stop of a moving elevator car. While the doors of the elevator car will not automatically open when the car is still outside the landing zone, passengers may attempt to force the doors open, against the frictional retarding force of the door operating mechanism. While the doors may be mechanically locked, such as when the car starts a run, and mechanically unlocked at floor level, such as by a cam located at each floor which unlocks and locks the lock mechanism on the car, this presents many problems. If the car is close enough to a landing that egress may be safely made, it would be undersirable to lock the doors and prevent passenger exit. This is especially true during a general power outage, which would unduly delay authorized personnel from attending each elevator car, because of the number of elevator cars which may be stranded. Also, even when outside the landing zone, a slight opening of the car doors for ventilation purposes is beneficial, as long as the doors do not open to the extent of permitting passenger exit. Still further, there are certain times when mechanical door locks are completely undesirable. For example, firemen use elevator cars to take equipment close to the floor of a fire, with the fireman placing the car in a firemen's mode, using a keyed switch, which allows them to have more complete control over the operation of the car and its doors. A mechanical lock of the car doors outside the landing zone would thus be undesirable. Other instances where mechanical door locks would be undesirable are during a hospital emergency mode, and when the elevator car is operated by maintenance personnel on "hand" control.

Application Ser. No. 375,249 filed May 5, 1982, entitled "Elevator System" discloses an electromechanical door lock arrangement which locks and unlocks the closure means or car door according to the position of the elevator car relative to a floor or a landing. Power failure causes the door to be locked without regard to car position. A battery is disclosed for operating the door lock arrangement when the normal power supply fails.

SUMMARY OF THE INVENTION

Briefly, the present invention relates to an improvement of the elevator system disclosed in Application Ser. No. 375,249. Instead of requiring batteries to be carried by the elevator car for operating the solenoid associated with the electromechanical locking mechanism, the present invention enables the car door to be unlocked, following a power failure, when the car is stopped within a predetermined allowable displacement zone relative to a floor, by a capacitor, a permanent magnet, and by slight movement of the closed car door by a passenger. Movement of the car door by a passenger in such a situation completes an electrical circuit which causes the capacitor to discharge through a second solenoid coil arranged to unlock the door lock. The permanent magnet maintains the door lock in this unlocked position until continued movement of the car door by a passenger overcomes the effect of the permanent magnet to return the door lock to its locked position. Instead of locking the door, however, the locked position of the door now operates as a "door release", preventing it from reclosing completely and accidentally locking.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
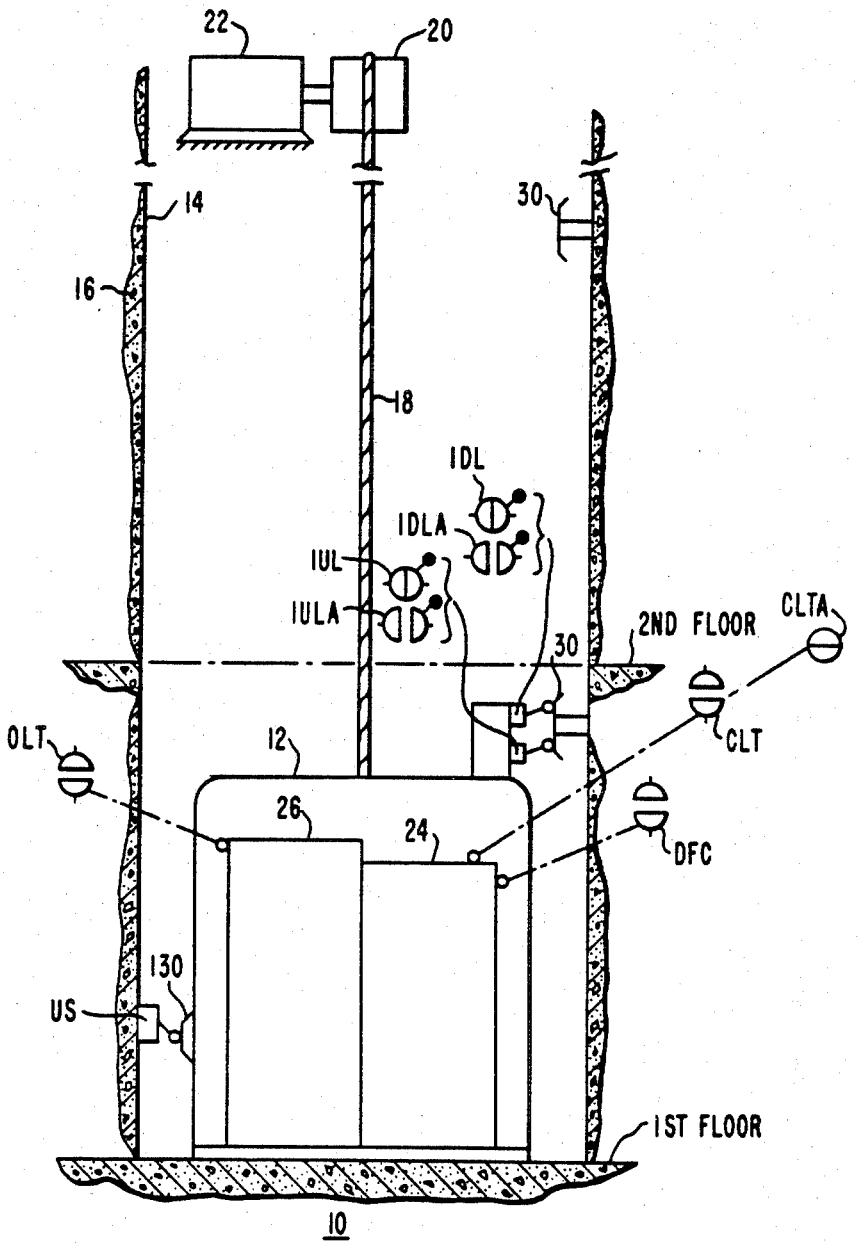
FIG. 1 is an elevational view of an elevator system which may utilize the teachings of the invention.

In order to limit the length and complexity of the present application, only those portions of an elevator system which are necessary in order to understand the present invention will be described. The invention may be implemented by electromechanical relays, solid state logic gates, or microprocessor. For purposes of example, a relay implementation is disclosed. U.S. Pat. Nos. 3,902,572, 4,042,068, and 4,317,506, which are assigned to the same assignee as the present application, disclose relay circuitry for controlling certain of the electrical contacts included in the drawings of the present application, and these patents, as well as the hereinbefore mentioned application Ser. No. 375,249, are hereby incorporated into the present application by reference.

Referring now to the drawings, and to FIG. 1 in particular, there is shown an elevator system 10 which may be modified according to the teachings of the invention. The invention applies to elevator systems having any type of motive means, such as electric traction elevators and hydraulic elevators. For purposes of example, elevator system 10 is illustrated as being of the electric traction type. Elevator system 10 includes an elevator car 12 mounted for guided vertical movement in the hatchway 14 of a structure or building 16 having a plurality of landings or floors to be served by car 12. Only the first and second floors are shown, as the operation of the elevator system is similar for each floor.

Elevator car 12 is supported in hatchway 14 by a plurality of wire ropes 18 which are reeved over a traction sheave 20. Traction sheave 20 is connected to a drive machine 22, which includes either an AC or a DC drive motor and a suitable source of electrical potential.

Elevator car 12 includes an opening 24 to a passenger compartment, and closure means in the form of one or more door panels, such as door panel 26, hereinafter simply referred to as door 26. Door 26 which is operated to control passenger movement between the car 12 and an adjacent landing. The hatch doors at the landings, which are operated in unison with the car door 26, are not shown.

FIG. 1 illustrates certain limit switches which are actuated by door 26 when it is in certain positions. Car door 26 is illustrated in its fully open position in FIG. 1, and in its fully closed position in FIG. 2. When door 26 is fully closed, a n.o. door close limit switch DFC is actuated to its closed position. When door 26 starts to open, and reaches only about ¼ inch from the fully closed position, a n.o. limit switch CLT is actuated to its open position and a n.c. limit switch CLTA is actuated to its closed position. When door 26 is fully open, a n.c. limit switch OLT is actuated to its open position.

The position of elevator car 12 adjacent to a landing, for purposes of accurately landing the car, and for releveling the car, such as may be necessary due to rope stretch or contraction as the load changes, may be accomplished in many different ways. For example, it may be accomplished by magnetic markers in the hatchway and an inductor relay on the car; by reflectors of electromagnetic radiation, or shields for such radiation, disposed in the hatchway, and an optoelectronic detector on the car; or, by cams disposed in the hatchway and mechanical switches on the car. For purposes of example, the cam/switch arrangement is illustrated in FIG. 1.

More specifically, n.c. switches 1DL and 1UL, carried by the car 12, are both actuated to their open positions by a cam 30 associated with each floor, when the floor of the passenger compartment is level with the hallway floor at which the car is stopped. Normally open switches 1DLA and 1ULA are auxiliary to 1DL and 1UL, respectively. Switches 1DL and 1UL are the normal leveling switches, providing signals over the conventional traveling cable for the car controller. Switches 1DLA and 1ULA provide signals for car mounted control, as will be hereinafter explained. If the car 12 should move downward slightly, switches 1UL and 1ULA will come off of cam 30 and switch 1UL will initiate "up leveling". If the car 12 should move upwardly, switches 1DL and 1DLA will come off of cam 30 and switch 1DL will initiate "down leveling".

Cam 30 defines a landing or leveling zone adjacent to its associated floor, when at least one of the switches 1UL and 1DL is actuated by cam 30, with this zone typically being ±3 or 4 inches, for a total zone length of 6 or 8 inches.

A zone of ±3 or 4 inches from floor level is a reasonable or allowable displacement zone relative to the floor level of an associated landing, which, if the car 12 were to stop in for an unscheduled length of time without opening its doors, the passengers could reasonably be allowed egress by forcibly opening the car doors. Thus, the landing cams 30 and leveling switches 1UL and 1DL may conveniently be used to provide signals for locking, and unlocking, the car doors according to car position.

A zone longer than ±3 or 4 inches may be safely used, and other zone establishing means of the elevator system may be used, or a dedicated switch and cams may be used, if desired, to define the allowable zone adjacent to a floor where the car door may be unlocked. Less equipment is involved, and retrofitting is much simpler, when existing elevator functions are used to provide the allowable zone signals, and, accordingly, are used in a preferred embodiment of the invention, as set forth in detail in FIG. 4.

Figure 2:
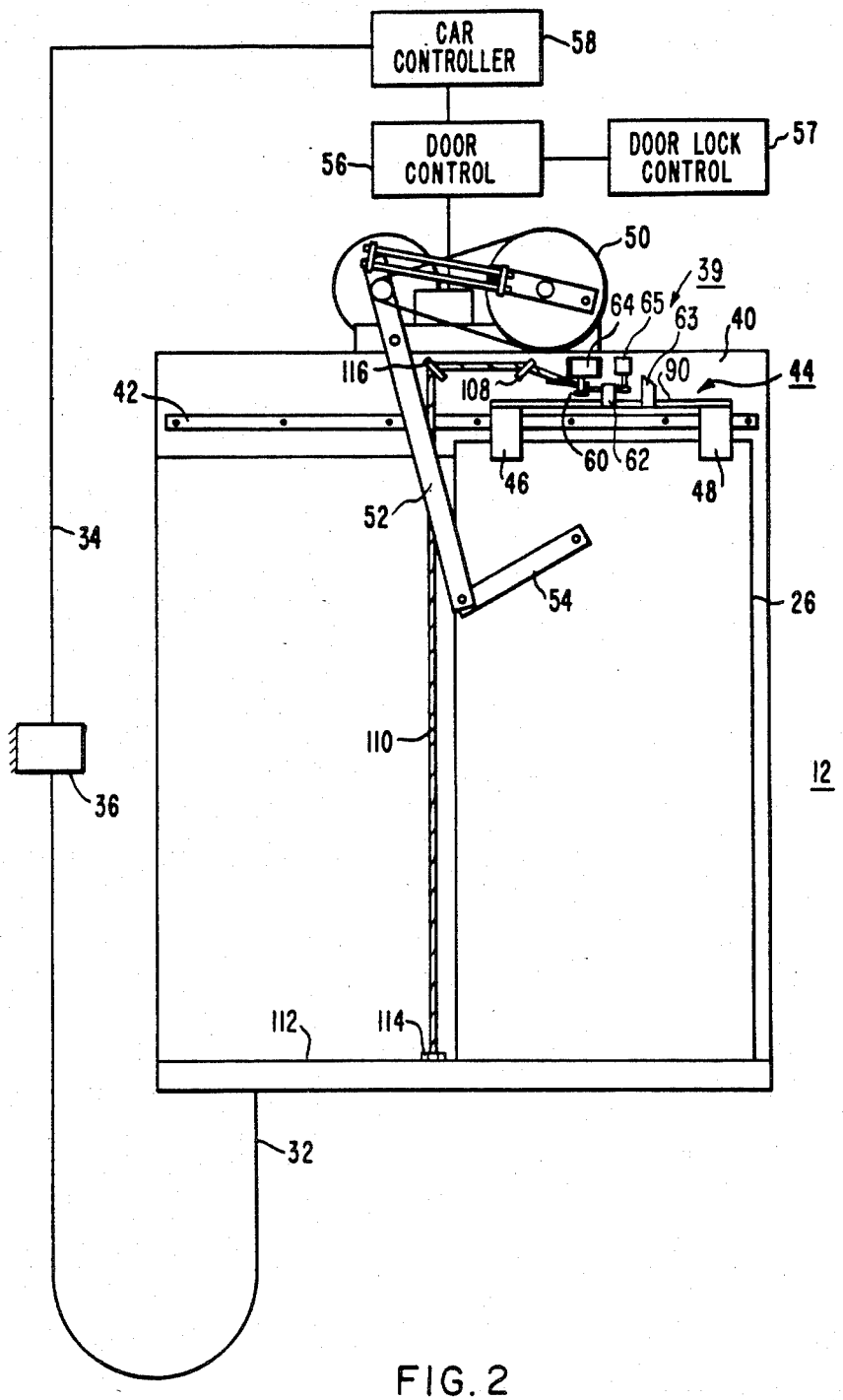
FIG. 2 is an enlarged, more detailed view of the elevator car shown in FIG. 1, having an electromechanical door lock constructed and mounted according to the teachings of the invention.

FIG. 2 is an enlarged view of elevator car 12, illustrating an electromechanical door lock assembly 39 and its associated control 57, applied to car 12 according to the teachings of the invention. Car 12 includes a door header 40 to which a hanger roller guide track 42 is mounted. A hanger assembly 44 is mounted on the top of door 26, which may include first and second spaced smaller hanger plates 46 and 48, to which hanger rollers (not shown) are journaled for rotation.

A door operator 50, mounted on top of car 12, is linked to door 26 via operating levers 52 and 54, with the door control being shown generally at 56, and with the door lock control being shown generally at 57. The door control 56 responds to signals from a floor selector, which is part of a car controller, with the car controller being shown generally at 58. Signals between the car controller 58 and car 12, as well as normal electrical power for car 12, utilize a traveling cable 32, a fixed cable 34, and a junction box 36.

Figures 3, 3A:
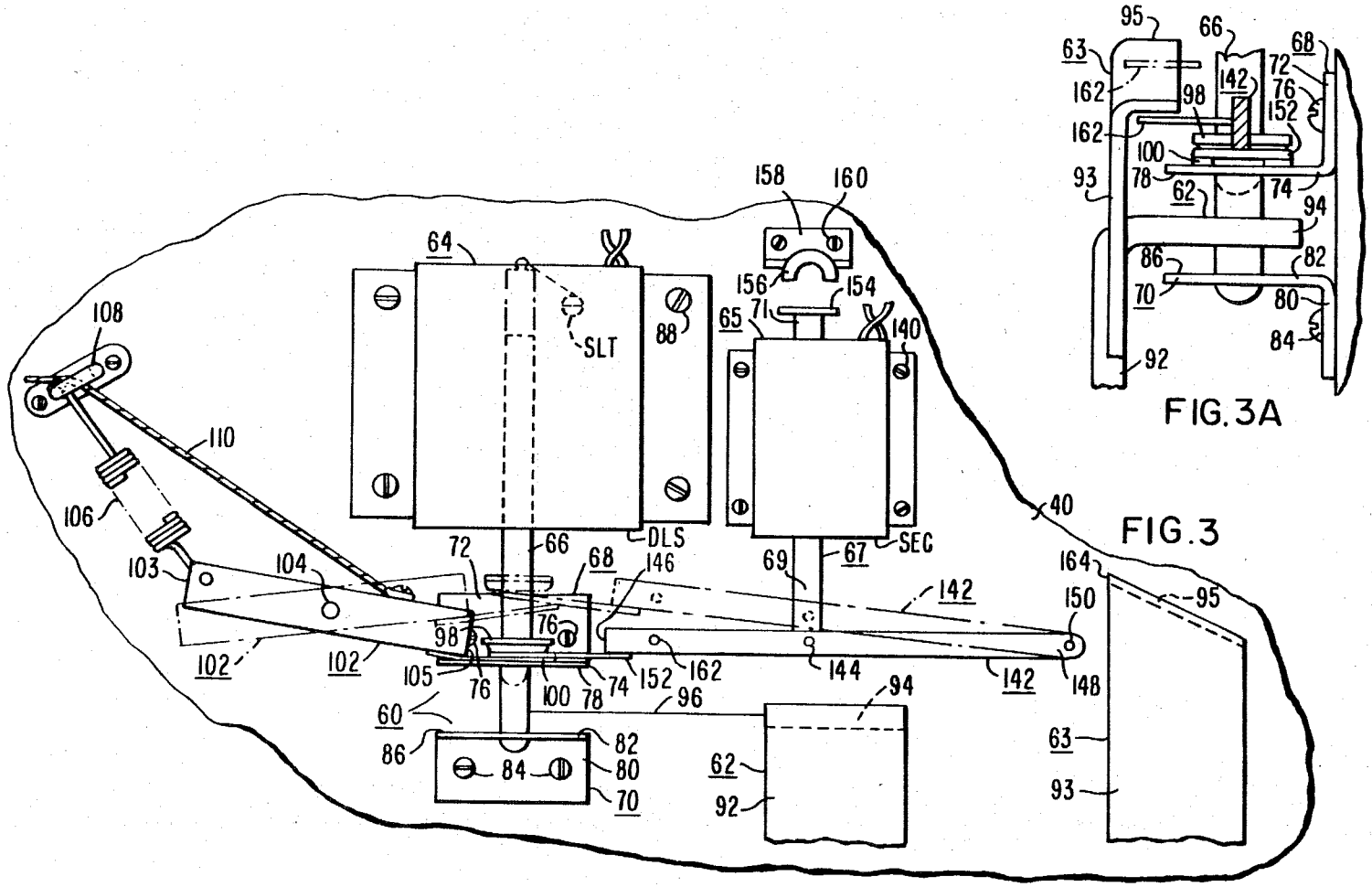
FIG. 3 is an enlarged elevational view of the door lock mechanism shown in FIG. 2.
FIG. 3A is a fragmentary, side elevational view of the bracket elements of the door lock mechanism shown in FIG. 3.

The electromechanical door lock assembly 39, which is shown enlarged in FIG. 3, and in a fragmentary side elevational view in FIG. 3A, includes first bracket means 60 fixed to the door header 40, second and third bracket means 62 and 63 respectively, fixed to the door 26, such as to the hanger assembly 44, and first and second electrical solenoid assemblies 64 and 65, respectively. Solenoid assembly 64 includes an electrical coil DLS, an armature or iron core plunger 66, and a n.o. limit switch SLT which is actuated to its closed position when coil DLS is energized and plunger 66 is lifted within coil DLS. Electrical solenoid assembly 65 includes an electrical coil SEC, and an armature or iron core plunger 67 having upper and lower ends 69 and 71, respectively, which extend outwardly from opposite ends of coil SEC.

The first bracket means 60 may include a single mounting base and a pair of spaced projections or leg portions, or, as illustrated, it may be formed by first and second L-shaped bracket members 68 and 70. Bracket members 68 and 70 are formed of a strong, non-magnetic material, such as brass. Bracket member 68 has first and second leg portions 72 and 74, respectively, with leg portion 72 functioning as a mounting base which is attached to door header 40, such as via screws 76. Leg portion 74 extends perpendicularly outward from header 40, with its major flat surfaces, such as surface 78, facing downwardly, parallel with the floor of car 12, i.e., horizontally oriented.

In like manner, bracket member 70 has first and second leg portions 80 and 82, respectively, with leg portion 80 functioning as a mounting base which is attached to door header 40, such as via screws 84. Leg portion 82 extends perpendicularly outward from header 40, with its major flat surfaces, such as surface 86, facing upwardly, and horizontally oriented.

Surfaces 78 and 86 of the first bracket means 60 are spaced a predetermined dimension from one another, and their associated leg portions 74 and 82, respectively, have openings therein which are in vertical alignment, for receiving plunger 66. These openings are sized just slightly larger than the diameter of plunger 66, allowing the plunger 66 to move freely up and down without interference with the first bracket means, but close enough to plunger 66 to function as a guide, and also as a support against lateral forces, as will be hereinafter explained.

Solenoid assembly 64 is mounted on header 40, such as via screws 88, and it is located such that plunger 66, when coil DLS is deactivated, will drop by gravity to the solid line position shown in FIGS. 3 and 3A. In this solid line deactivated position, it extends through both of the aligned openings, including the opening in the lower leg portion 82. When the solenoid coil DLS is energized, plunger 66 is lifted into the coil to the broken line position shown in FIGS. 3 and 3A. It is important to note that plunger 66, even in the retracted position, is still within the opening of the upper leg portion 74, and it is thus positively guided at all times.

The second and third bracket means 62 and 63, respectively, are mounted to be carried by the door 26 as it moves between its open and closed positions. If the hanger plate is a single plate, the second and third bracket means 62 and 63 may be mounted at the top thereof. If spaced hanger plates 46 and 48 are used, a bar or rod member 90 may be mounted between the plates 46 and 48, and the second and third bracket means 62 and 63 fixed to member 90.

The second bracket means 62, which may be formed of steel, since it will not contact plunger 66 when solenoid coil DLS is energized, may be an L-shaped bracket having first and second right angle leg portions 92 and 94, respectively. Leg portion 92 may function as a mounting base, which is suitably fixed to member 90. Bracket means 62 is oriented such that leg portion 94 is at the upper end thereof, with the end of the leg portion extending inwardly toward door header 40. Leg portion 94 is positioned such that when door 26 is operated between its open and closed positions, it will pass freely between surfaces 78 and 86 without interference, and without striking plunger 66, when plunger 66 is lifted to its energized position. When plunger 66 is dropped to its deenergized position, leg portion 94 is dimensioned and positioned such that it will strike plunger 66, forming a positive lock against any further movement of door 26. Thus, when door 26 is closed and plunger 66 is in its deenergized position, door 26 can be moved toward its open position only by a small dimension 96. Dimension 96 is selected such that it will be sufficient to provide car ventilation, without opening to the extent of allowing passenger exit.

The leg portions 74 and 82 of the first bracket means 60 form a strong support structure for plunger 66 against lateral forces which may be applied thereto by the second bracket means 62. It is important to prevent lateral forces which are applied to plunger 66 from being transmitted to a non-magnetic tube (not shown) which surrounds the iron plunger within the coil DLS.

In addition to positively limiting the extent of door opening when solenoid coil DLS is deenergized, it may also be used to provide a door release function when the car is shut down and power removed. To function in this mode, power is removed while the door 26 is open, dropping plunger 66 into its blocking position. Thus, door 26 cannot be fully closed.

The third bracket means 63, which may be formed of steel, includes first and second leg portions 93 and 95. Leg portion 93 may be suitably fixed to member 90. Leg 95 functions as a cam, and it is disposed at a predetermined angle from the horizontal, as will be hereinafter explained.

The second solenoid assembly 65 is mounted on header 40, such as via screws 140. The lower end 69 of plunger 67 is pivotally connected to an intermediate portion of a lever 142 via a pin 144. Lever 142 includes first and second ends 146 and 148, respectively. The second end 148 is pivotally fixed to header 40 via a pivot pin 150, and a lifting finger 152 is fastened to its first end 146. A ring member 98 is fixed to an intermediate portion of plunger 66, in a position which enables lifting finger 152 to fit between ring member 98 and the leg portion 74 when both solenoids 64 and 65 are deenergized.

A steel keeper plate 154 is fixed to the second end 71 of plunger 67, with the keeper plate 154 being spaced from a permanent magnet 156 by a predetermined dimension when solenoid 65 is deenergized. Permanent magnet 156 is fastened to header 40 via a suitable bracket 158 and screws 160.

When electromagnetic coil SEC of solenoid 65 is energized, plunger 67 is lifted vertically, lever 142 is pivoted upwardly about pin 150, and lifting finger 152 engages ring 98 to lift plunger 66 of solenoid coil DLS to its broken outline position, which is the unlocked position. When plunger 67 rises, the keeper plate 154 enters the attractive magnetic field of permanent magnet 156, and magnet 156 thus captures and holds plate 154 and plunger 67 in its energized position, notwithstanding deenergization of coil SEC. Thus, plunger 66 is maintained in its unlocked position by permanent magnet 156.

Lever 142 includes a rod 162 fixed near its first end 146 which extends perpendicularly outward from its surface which is opposite to the surface which faces header 40. Rod 162 assumes its broken outline position shown in FIGS. 3 and 3A when plunger 67 is elevated.

Leg 95 of bracket 63 is dimensioned such that its leading edge 164, with reference to a door opening movement, is its uppermost end. End 164 is elevated such that the underside surface of leg 95 will contact rod 162 when rod 162 is in its elevated, broken outline position, as the car door moves from its closed position towards its open position, camming rod 162 down the inclined lower surface to its solid outline position. Keeper plate 154 is moved vertically downward, out of the attractive field of permanent magnet 156. Thus, as will be hereinafter more fully explained, solenoid coil arrangement 65 is used to unlock the electromechanical door lock arrangement 39 in a predetermined situation. Permanent magnet 156 maintains the unlocked condition, but only when the arrangement is unlocked by the solenoid arrangement 65, and not when unlocked by the solenoid arrangement 64. Bracket 63 overrides the holding feature provided by permanent magnet 156, forcing the lock arrangement 39 back to its locked position after leg 94 of bracket 62 passes through the leg portion 78 and 82 of bracket 68 and 70, respectively. Thus, when the plunger 66 of the lock arrangement 39 is dropped, the door cannot fully reclose, preventing accidental locking of the car door.

A mechanical override feature may be provided when actuatable by authorized personnel from outside the elevator car. In this arrangement, a lifting finger 100 is disposed between lifting finger 152 and the upper surface of leg portion 74 of bracket 68. Finger 100 is fastened to an operating lever 102 having first and second ends 103 and 105, respectively, with lever 102 being pivotally fixed to header 40 about a pivot axis 104. Finger 100 is fixed adjacent to the second end 105 of lever 102, and lever 102 is biased in a clockwise direction, as viewed in FIG. 3, by a tension spring 106. One end of spring 106 is linked to the first end 103 of the operating lever 102, and the other of spring 106 is linked to a staple member 108. Member 108 is fixed to header 40. Thus, lever 102 is biased such that finger 100 is pressed downwardly against the upper surface of leg portion 74.

A cable 110 is provided which has one end secured near the second end 105 of lever 102, and it is directed to extend through a pair of guides to the door sill 112, where it is anchored at 114. The staple member 108 may function as the first guide for the cable 110, and a similar staple member 116 may function as the second guide point. The cable 110 extends upwardly from lever 102 through staple member 108, and then laterally away from opening 24 of the car 12 to the guide 116. Guide 116 is located such that when cable 110 is directed vertically downward therefrom to anchor 114, it will clear the door 26 as it is operated between its open and closed positions, and also be out of visual sight back of the return jam when the door 26 is open. If the car 12 stops away from floor level, or is otherwise stopped with the electromechanical lock 39 deenergized to lock the door 26, authorized personnel can release the hatch door closest to the car with a special key, and apply a lateral pulling force to cable 110. Pulling cable 110 pivots lever 102 in a counterclockwise direction, as viewed in FIGS. 2 and 3, to the broken line position shown in FIG. 3, causing finger 100 to lift finger 152 and plungers 66 and 67. The magnet 156 will hold this unlocked position, allowing leg portion 94 of the second bracket means 62 to pass through the space defined by the spaced leg portions 74 and 82 of the first bracket means 60. The camming action of bracket 63 will release the plungers 66 and 67, and thus the door cannot return to its fully closed position.

If the car is stopped with the car door vane engaged in the hatch door drive blocks, the hatch door can be opened to the extent of dimension 96 shown in FIG. 3, which dimension is selected to be sufficient to enable authorized personnel to reach between the hatch door and jamb to release the interlock, and to then pull the release cable 110.

Figure 4:
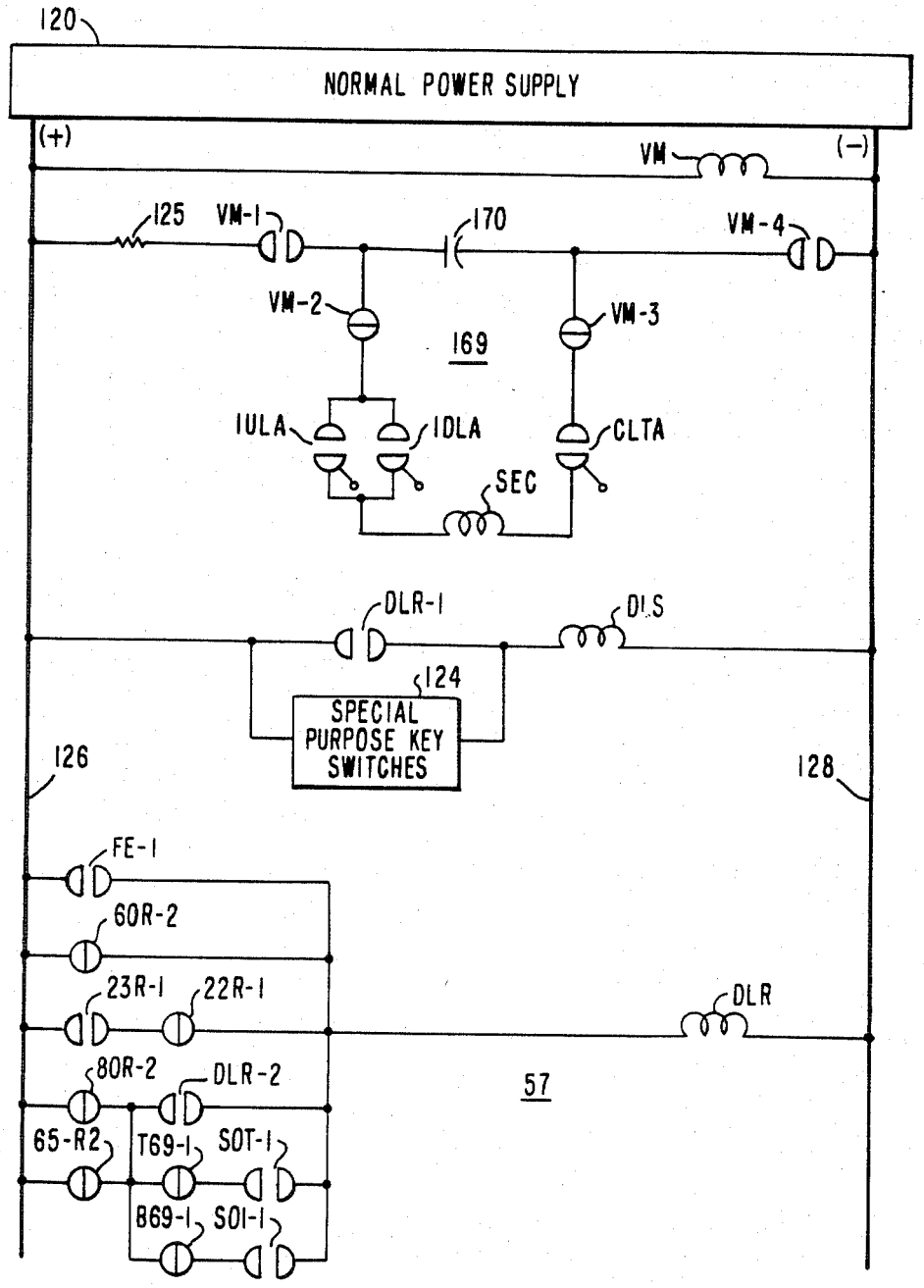
FIG. 4 is a schematic diagram of electrical controls for implementing the electromechanical door lock function.

FIG. 4 is a schematic diagram illustrating electrical door lock control 57 arranged to implement the teachings of the invention. The relays which are part of the door control 56 shown in block form in FIG. 2 are not shown in FIG. 4, as they may be conventional. They are shown in FIG. 4, of the incorporated application. The relays shown in FIG. 4, as well as those not shown but whose contacts are shown, are listed in the following table.

TABLE

| Relay | Function |
|---|---|
| B69 | Bottom Floor Relay - This relay is energized except when the car is at the bottom floor. |
| DLR | Door Latch Relay - When energized, it energizes the door latch solenoid DLS to unlock the car door. When deenergized, it deenergizes DLS to lock the car door. |
| DLS | Door Latch Solenoid |
| FE | Fire Emergency Relay - This relay is energized during a fire emergency. |
| SOT | Floor Selector Relay - This relay is energized when the selector notches in to the top floor. |

TABLE-continued

| Relay | Function |
|---|---|
| SO1 | Floor Selector Relay - This relay is energized when the selector notches in to the bottom floor. |
| T69 | Top Floor Relay - This relay is energized except when the car is at the top floor. |
| VM | Voltage Monitor Relay - This relay drops out when the normal power supply fails. |
| 22R | Leveling Zone Relay - This relay drops out when the car is in the leveling zone of a target floor. |
| 23R | Running Relay - This relay picks up at the start of a run and drops out when the run has been completed. |
| 60R | "Hand" Relay - This relay is picked up on automatic operation, and dropped out on hand operation. |
| 65R | Running Relay - This relay picks up at the start of a run, and it drops out at the end of a run. |
| 80R | Master Start Relay - This relay picks up to initiate a run. |

The embodiment of the invention shown in FIG. 4 uses the landing and leveling control of an elevator system to define the "locked" and "unlocked" zones, but any suitable means may be used to define these zones.

More specifically, it will first be assumed that the normal DC power supply 120 is operative, energizing voltage monitor relay VM. Contacts VM-2 and VM-3 of relay VM are thus open, isolating the electromagnetic coil SEC of the second solenoid assembly 65 from a capacitor 170. The open contacts VM-2 and VM-3 also disable auxiliary leveling switches 1ULA and 1DLA. During normal power conditions, leveling switches 1UL and 1DL define the "locked" and "unlocked" zones. Contacts VM-1 and VM-4 of relay VM will be closed, enabling capacitor 170 to be charged from the normal power supply 120 via a resistor 125.

The door latch release relay DLR, during normal operation, is controlled by contacts 23R-1 and 22R-1 of relays 23R and 22R, respectively. These relays are shown in incorporated patent 3,902,572. Relay 23R picks up at the start of a run, and drops out when the run has been completed. Relay 22R is energized until the car 12 is in the leveling zone of a target floor, and it is deenergized as long as at least one of the leveling switches is on cam 30. Thus, when car 12 is making a run, contact 23R-1 will be closed and contact 22R-1 will be open. Relay DLR and solenoid DLS will be deenergized, and the car door will be locked in its closed position. When car 12 approaches a target floor, relay 22R will drop out as soon as switch 1UL, or switch 1DL, engages cam 30. Its contact 22R-1 thus closes to energize DLR, contact DLR-1 closes to energize solenoid DLS, and the door is unlocked. Before relay 23R drops, a seal-in circuit is made, which includes contact DLR-2, and either contact 80R-2 or contact 65R-2. Master start relay 80R drops before relay 23R drops to establish the seal. When the car direction circuits open, running relay 65R drops, as does relay 23R, with contact 65R-2 providing a seal-in path which survives the pick up of start relay 80R at the start of the next run.

At the start of the next run, relay 23R picks up before the seal-in circuit is broken, to maintain DLR and DLS energized until both leveling switches 1UL and 1DL are off cam 30. When both are off cam 30, relay 22R picks up to deenergize relay DLR and solenoid DLS.

This arrangement insures that the car door will be fully closed before the locking function is initiated.

During automatic operation of the elevator car 12, relay 60R will be energized, and thus its contact 60R-2 will be open. When service personnel take over the operation of car 12 and place it on "hand" control, they deenergize relay 60R, such as via a key switch. Thus, on hand control, contact 60R-2 energizes relay DLR and solenoid DLS, and service personnel can operate the car and doors without having to contend with the door lock 39.

In the event of a fire emergency, which may be initiated by authorized personnel via a key switch, a fire emergency relay FE is energized. Its contact FE-1 thus closes, energizing DLR and DLS during this operating mode. Thus, when firemen take over control of the car, they will have complete control of the car doors.

During a power failure, a self contained, car mounted circuit 169 for operating solenoid coil SEC on a one-shot basis is enabled by the dropping out of the voltage monitor relay VM. Circuit 169 requires no signals or electrical power from the traveling cable 32. Thus, this emergency circuit will be ready to operate during a power failure.

More specifically, when the normal power supply 120 fails to hold relay VM in its actuated position, contacts VM-1 and VM-4 open immediately to isolate capacitor 170 from the conductors 126 and 128 of the normal power supply 120, maintaining capacitor 170 in its charged condition. Contacts VM-2 and VM-3 close to connect capacitor 170 to the circuit 169 which includes coil SEC, the auxiliary leveling switches 1ULA and 1DLA, and door switch CLTA. It is important to note that coil SEC is not automatically energized by virtue of the elevator car being close enough to a floor level to actuate one of the auxiliary switches 1ULA or 1DLA. The energization of coil SEC additionally requires the attempt by someone, such as a passenger in the elevator car, to start to open the car door manually. As soon as the door is opened to the extent necessary to close door switch CLTA, such as about ¼ inch of door movement, circuit 169 will be completed and capacitor 170 will discharge through coil SEC of solenoid assembly 65. The resulting current surge through coil SEC will lift plunger 69 and permanent magnet 156 will maintain plunger 69 in its elevated position. When plunger 69 is lifted, finger 152 lifts plunger 66 of solenoid assembly 64 to unlock the door. Thus, by the time leg 94 of bracket 62 reaches the bracket 68 and 70, due to continued opening effort applied to the car door by a passenger in the elevator car, the door will be unlocked, enabling leg 94 to pass through legs 82 and 74. Continued opening effort of the door will cause leg 95 of bracket 63 to cam rod 162 downward, to release the hold of permanent magnet 156 on keeper plate 154. Plunger 69 will thus drop, allowing plunger 66 to drop, with plunger 66 now preventing the car door from completely closing. Thus, the car door cannot be accidentally locked, allowing all passengers to exit the elevator car.

The reason circuit 169 is not energized by capacitor 170 automatically when power fails with the car close enough to a floor to close one (or both) of the auxiliary switches 1ULA or 1DLA, is the fact that a passenger may not immediately try to open the door. If the doors were to be automatically unlocked and then power returns before someone opens the door sufficiently to release the keeper plate 154 from the permanent magnet 156, the car may be started toward a terminal floor for the purpose of resetting the floor selector. If the power should fail again, before the car reaches a terminal floor, and with the car outside an allowable displacement zone relative to an intermediate floor, the car door will still be unlocked. Thus, the invention requires that someone start to manually open the doors of the elevator car, in addition to the car being located in an allowable displacement zone, before capacitor 170 is allowed to initiate the unlocking of the car door.

In the event of a power failure, with no attempt being made by passenger to open the car door, an initializing routine functions when power returns. This routine may include running the elevator car 12 to a terminal floor to reset the floor selector. At the end of this run, contacts 23R-1 and 22R-1 will function as hereinbefore described to unlock the car door 26 when the leveling zone of the terminal floor is reached. If the car is at a terminal floor when power returns, the selector will be reset without running the car, and thus contacts 23R-1 and 22R-1 will not unlock the car door. Thus, contacts B69-1 and S01-1 are provided, which energize DLR and DLS when the car is at the bottom terminal floor. Switch US, shown in FIG. 1, is actuated by a cam 130 when the car is at the bottom floor. Switch US controls relay B69, deenergizing it when it is actuated by cam 130. Contact S01-1 will be closed, as the floor selector relay S01 will be energized when the car 12 is located at the bottom floor.

In like manner, contacts T69-1 and S0T-1 provide the same function for the upper terminal floor. Cam 130 actuates a switch similar to switch US when the car is at the top floor, deenergizing upper terminal relay T69. Floor selector relay S0T will be energized when car 12 is at the upper terminal floor. Relays B69, T69, S01 and S0T are shown in incorporated U.S. Pat. No. 4,317,506.

In summary, there has been disclosed a new and improved elevator system having an electromechanical door lock, with the door lock having the flexibility necessary to enable it to: (a) function with a normal power supply to automatically lock the car door when the car is outside an allowable displacement zone from a floor, and to automatically unlock the car door when the car is in such a zone, (b) to allow manual release of a locked car by authorized personnel from outside the elevator car, and (c) to allow electrical release of a locked car, when the car is within an allowable displacement zone, by passengers withiin the car, notwithstanding power failure, via a capacitor which is charged during normal operation of the elevator car.

I claim as my invention:

1. An elevator system, comprising:

a structure having a hatchway and a landing, an elevator car, means mounting said elevator car for movement in said hatchway to serve the landings, said elevator car having an opening, closure means actuatable between closed and unclosed positions for controlling passenger movement between the car and landings through said opening, means indicative of an allowable displacement zone of the elevator car relative to each landing within which the closure means may be actuated to allow passenger exit from the car, in the event the elevator car stops for an unscheduled length of time at a position other than level with a landing, lock means having a locked position which mechanically prevents actuation of said closure means, when closed, to an extent which would enable passenger exit from the car, and an unlocked position, first and second electromechanical means for actuating said lock means, a power supply for operating said first electromechanical means, capacitor means for operating said second electromechanical means, with said capacitor means being charged by said power supply, said first electromechanical means being responsive to the position of said elevator car, actuating said lock means to its locked and unlocked positions when said elevator car is outside and inside, respectively, an allowable displacement zone, said first electromechanical means being responsive to failure of said power supply, actuating said lock means to its locked position in response to such a failure, said second electromechanical means being responsive to failure of said power supply, the location of the elevator car within an allowable displacement zone, and a predetermined forced movement of the closure means away from its closed position, to unlock said closure means via the charge stored on said capacitor means.

2. The elevator system of claim 1 wherein the lock means, when it is in its locked position, prevents the closure means:

(a) from opening beyond a predetermined small dimension, when closed, and (b) from fully closing, when it is open beyond the predetermined small dimension.

3. The elevator system of claim 1 including holding means for maintaining the lock means in its unlocked position, when unlocked by the second electromechanical means, and means for overcoming and holding means to return the lock means to its locked position in response to predetermined opening movement of the closure means, with the locked position of the lock means now preventing full closure of the closure means.

4. The elevator system of claim 3 wherein the second electromagnetic means includes an armature which is lifted in response to current provided by the capacitor means, to actuate the lock means to its unlocked position, the holding means includes a permanent magnet disposed to maintain the armature in its lifted position, and the means for overcoming the holding means includes means carried by the closure means which mechanically forces the armature away from the attractive field of the magnet, to cause the armature to fall and actuate the lock means to its locked position.

5. The elevator system of claim 1 wherein the first electromagnetic means includes a solenoid having an armature which is lifted to actuate the locked means to its unlocked position, and dropped to actuate the lock means to its lock position, and including: (a) mechanical means for lifting the solenoid from outside the elevator car, (b) holding means for holding the lock means in its unlocked position when unlocked by either the mechanical means or the second electromagnetic means, and (c) means for overcoming said holding means to return the lock means to its locked position in response to predetermined opening movement of the closure means, with the lock position of the lock means now preventing full closure of the closure means.

6. The elevator system of claim 5 wherein the second electromagnetic means includes an armature which is lifted in response to either current provided by the capacitor means, or by the mechanical means, to actuate the lock means to its unlocked position, the holding means includes a permanent magnet disposed to maintain the armature of the second electromagnetic means in its lifted position, and the means for overcoming the holding means includes means carried by the closure means which mechanically forces the armature of the second electromagnetic means away from the attractive field of the magnet.

* * * * *